US009254641B2

(12) United States Patent
Ong et al.

(10) Patent No.: US 9,254,641 B2
(45) Date of Patent: Feb. 9, 2016

(54) SCREEN PRINTER, AND METHOD OF CLEANING A STENCIL OF A SCREEN PRINTER

(71) Applicant: ASM TECHNOLOGY SINGAPORE PTE. LTD., Singapore (SG)

(72) Inventors: See Yap Ong, Singapore (SG); Kun Quan Fan, Singapore (SG); Ka Shing Kwan, Singapore (SG)

(73) Assignee: ASM Technology Singapore Pte. Ltd., Singapore (SG)

( * ) Notice: Subject to any disclaimer, the term of this patent is extended or adjusted under 35 U.S.C. 154(b) by 274 days.

(21) Appl. No.: 13/958,895

(22) Filed: Aug. 5, 2013

(65) Prior Publication Data

US 2015/0033966 A1 Feb. 5, 2015

(51) Int. Cl.

| | |
|---|---|
| ***B41F 15/08*** | (2006.01) |
| ***B41F 35/00*** | (2006.01) |
| ***B41F 15/12*** | (2006.01) |
| ***B41F 15/20*** | (2006.01) |

(52) U.S. Cl.

CPC ..... *B41F 35/003* (2013.01); *B41F 15/12* (2013.01); *B41F 15/20* (2013.01); *B41F 35/005* (2013.01); *B41P 2215/00* (2013.01); *B41P 2215/12* (2013.01)

(58) Field of Classification Search

CPC ..... B41F 15/08; B41F 15/12; B41F 35/003; B41F 35/005; B41P 2215/11; B41P 2215/00; B41P 2215/12; B41P 2215/50; B08B 3/11; B08B 3/02; B08B 3/024

See application file for complete search history.

(56) References Cited

U.S. PATENT DOCUMENTS

| | | | | |
|---|---|---|---|---|
| 5,145,432 | A * | 9/1992 | Midland et al. | 445/3 |
| 2002/0081025 | A1* | 6/2002 | Wagman | 382/170 |
| 2002/0104454 | A1* | 8/2002 | Verschueren | 101/450.1 |
| 2008/0289518 | A1* | 11/2008 | Inoue et al. | 101/123 |
| 2011/0192301 | A1* | 8/2011 | Abe et al. | 101/423 |
| 2012/0090652 | A1* | 4/2012 | Hsieh et al. | 134/198 |
| 2014/0000468 | A1* | 1/2014 | Perault et al. | 101/425 |
| 2014/0366756 | A1* | 12/2014 | Gray | 101/129 |

FOREIGN PATENT DOCUMENTS

| | | | | |
|---|---|---|---|---|
| JP | 05-177811 | * | 7/1993 | B41F 15/08 |
| JP | 06-126928 | * | 6/1994 | B41F 15/08 |

* cited by examiner

*Primary Examiner* — Blake A Tankersley
*Assistant Examiner* — Marissa Ferguson Samreth
(74) *Attorney, Agent, or Firm* — Sughrue Mion, PLLC

(57) ABSTRACT

An SMT screen printer 100 is disclosed herein. In a described embodiment, the screen printer 100 comprises: i) a stencil 110 with a plurality of apertures; ii) a paste dispenser arranged to dispense a paste material through the plurality of apertures of the stencil to form a print pattern of the stencil to form a print pattern of the paste material on an electronic device; iii) an image capturing device in the form of a fiducial camera 176 arranged to capture at least one image of the plurality of apertures 114 of the stencil 110; iv) a processor 180 arranged to select which of the apertures 114 require cleaning based on the at least one captured image; and v) a cleaning device 138 arranged to clean the selected apertures 114. A method of cleaning a stencil 110 of an SMT screen printer 100 is also disclosed.

12 Claims, 8 Drawing Sheets

SCREEN PRINTER, AND METHOD OF CLEANING A STENCIL OF A SCREEN PRINTER

BACKGROUND AND FIELD

This invention relates to a screen printer (or sometimes called "stencil printer") in the field of Surface Mount Technology ("SMT"), more particularly but not exclusively, for solder paste printing. This invention also relates to a method of cleaning a stencil (or a screen) of a screen printer.

In SMT, a stencil is normally placed over an electronic device, such as a printed circuit board (PCB) having solder pads on which respective leads of a surface mount component are placed. The stencil includes apertures which correspond to respective solder pads and a solder paste printing process is used to print solder paste on the solder pads. After a few printings, the apertures of the stencil may be partially blocked by residual solder paste and the entire stencil should be cleaned to prevent bridging, mis-printings or defects. For stencils with very small apertures (for example small area-ratio apertures), the apertures may become blocked more easily and it may be useful to clean the stencil after each printing. However, current cleaning methods tend to be relatively inefficient, take an unacceptably long time to clean the stencils and need a lot of cleaning material.

SUMMARY

In a first aspect of the invention, there is provided a screen printer, comprising: i) a stencil having a plurality of apertures; ii) a paste dispenser arranged to dispense a paste material through the plurality of apertures of the stencil to form a print pattern of the paste material on an electronic device; iii) an image capturing device arranged to capture at least one image of the plurality of apertures of the stencil; and iv) a processor operative to select which of the apertures of the stencil require cleaning based on the at least one captured image; and v) a cleaning device arranged to clean the selected apertures.

"Paste material" is used in this application to include solder paste, adhesive, and epoxy materials etc, depending on what is to be printed on the substrate.

An advantage of the described embodiment is that, with selective aperture cleaning, this achieves a more effective cleaning and use less resources (since only those apertures which require cleaning are cleaned). Further, a shorter cleaning time may be achieved.

The cleaning device may include an air jet module arranged to discharge jets of air for cleaning the selected apertures. The air jet module is particularly useful for cleaning ultra small apertures. The air jet module may include at least one air nozzle, and a resiliently biased cap supported by a brim of the at least one air nozzle. Advantageously, the at least one nozzle may include a plurality of air channels for enabling air from the air nozzle to escape to lift the resiliently biased cap away from the brim. In this way, during operation of the air nozzle, the cap is not in contact with the top surface of the stencil.

Preferably, the image capturing device may be arranged to capture multiple images with each image showing different apertures. This may be useful for larger stencils. Preferably, the image capturing device includes a fiducial camera for fiducial recognition as well as for capturing the at least one image of the apertures. In this way, the camera performs a dual function of fudicial recognition as well as for capturing the at least one image of the plurality of apertures. Alternatively, a separate and additional camera may be used for capturing the at least one image of the plurality of apertures.

Advantageously, the processor may be configured to compare the at least one captured image with at least one reference image to determine if amount of blockage of the apertures shown in the at least one image exceeds a threshold; wherein apertures having blockages which exceed the threshold are defined as the selected apertures.

The cleaning device may include a paper cleaning module for cleaning the selected apertures. The paper cleaning module may be configured to move in synchronization with the air jet module. In combination, this may achieve a more effective cleaning of the selected apertures.

According to a second aspect, there is provided a method of cleaning a stencil of a screen printer, the stencil having a plurality of apertures through which a paste material is dispensed to form a print pattern of the paste material on an electronic device, the method comprising (i) capturing at least one image of the plurality of apertures; (ii) selecting which of the apertures require cleaning based on the at least one captured image; and (iii) cleaning the selected apertures.

Cleaning the selected apertures may include discharging jets of air for cleaning the selected apertures. The jets of air may be pulsating jets of air.

The method may include capturing multiple images with each image showing different apertures. Preferably, the selection may include comparing the at least one captured image with at least one reference image; from the comparison, determining if amount of blockage of the apertures shown in the at least one image exceeds a threshold; selecting the apertures having blockages which exceed the threshold for cleaning.

It should be appreciated that features relating to one aspect may also be applicable to the other aspects.

BRIEF DESCRIPTION OF THE DRAWINGS

An example of the invention will now be described with reference to the accompanying drawings, in which.

DETAILED DESCRIPTION OF PREFERRED EMBODIMENT

Figure 1:
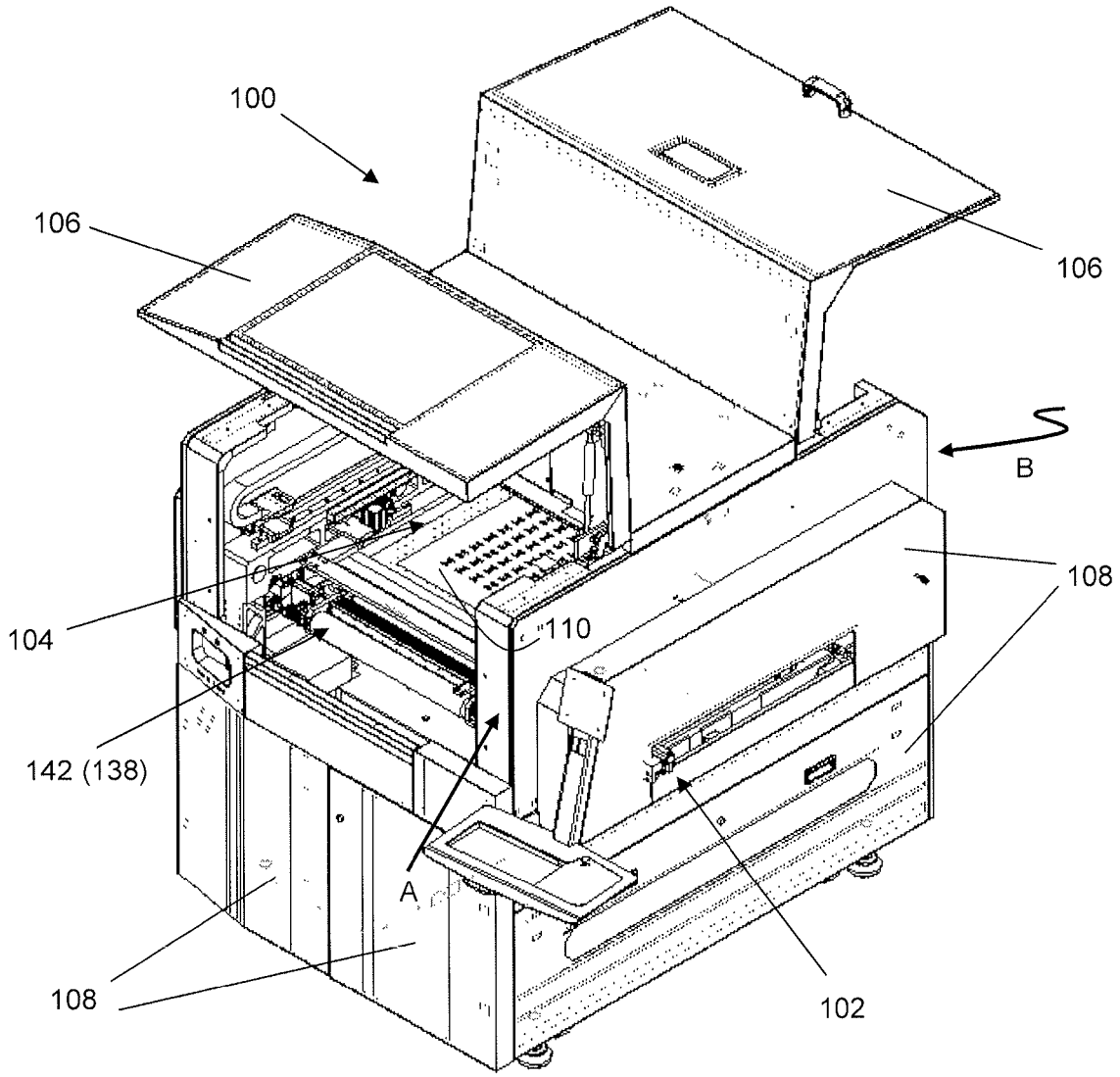
FIG. 1 is a perspective view of a SMT screen printer with covers lifted according to a preferred embodiment.

FIG. 1 is a perspective view of an SMT screen printer 100 comprising a conveyor system 102 for conveying substrates such as PCBs (not shown) into a printing chamber 104 of the screen printer 100. The screen printer 100 includes a pair of pivotable covers 106, shown in open positions in FIG. 1, to allow access to the printing chamber 104 and the pair of pivotable covers 106 is normally closed during operation of the screen printer 100. The screen printer 100 further includes a number of protective panels 108.

Figure 2:
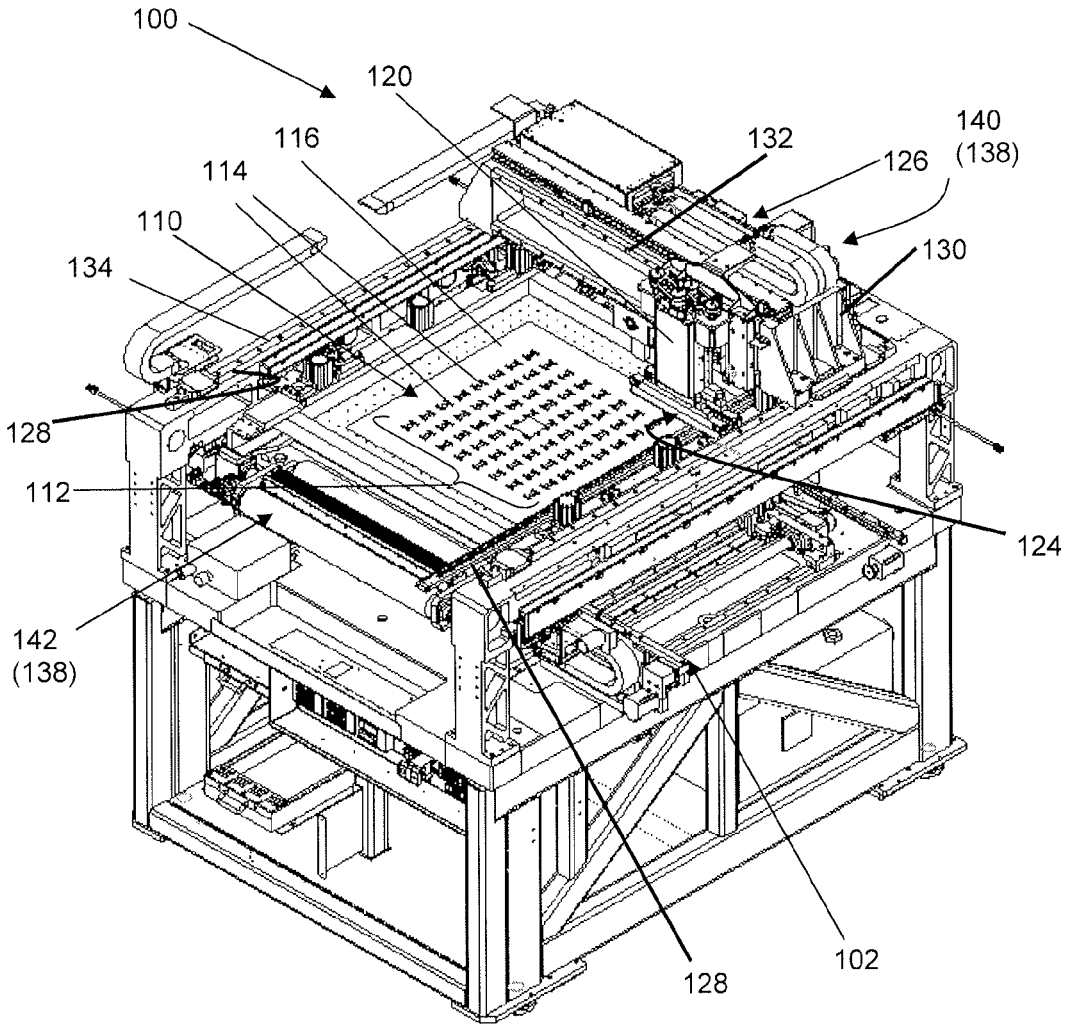
FIG. 2 is a perspective view of the SMT screen printer in direction A of FIG. 1, with the covers and some other parts omitted to show a print head and a paper cleaning module of a cleaning device.
Figure 3:
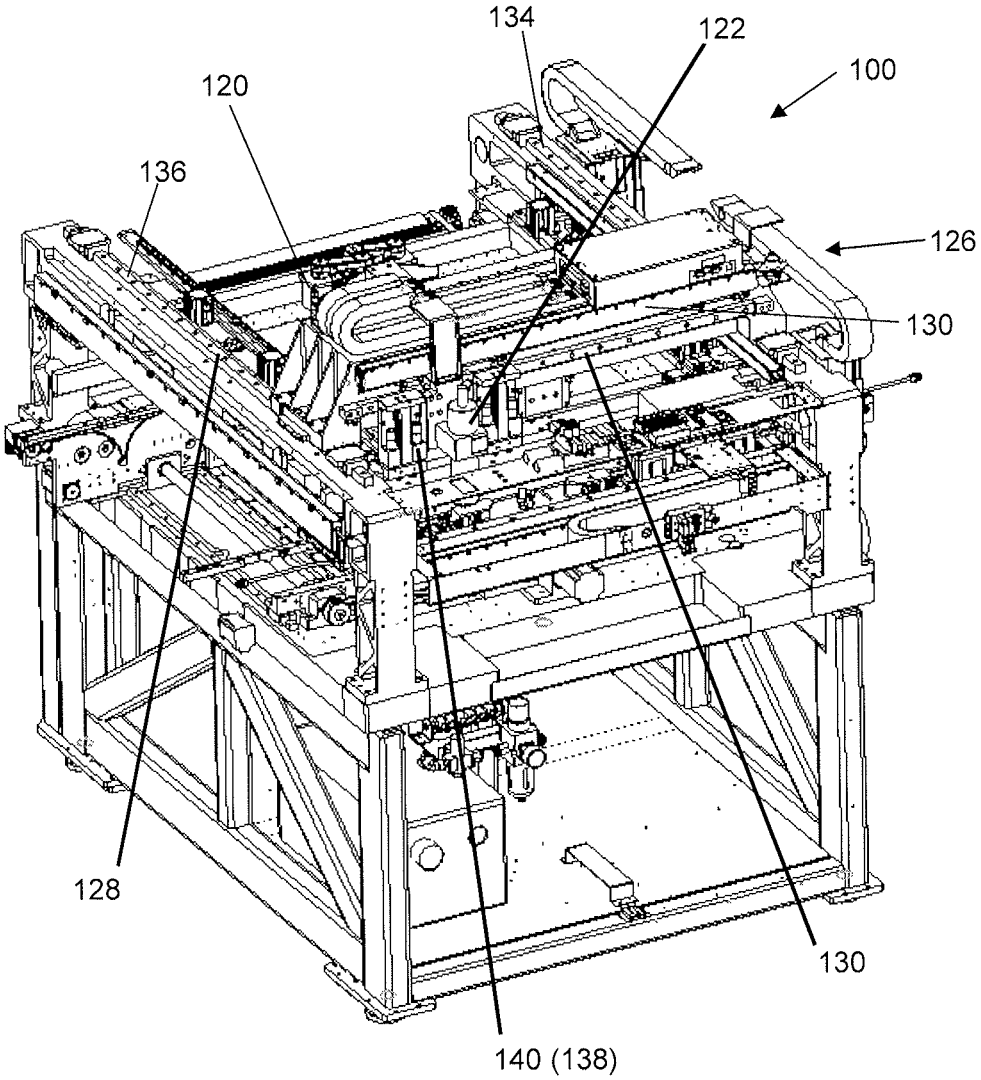
FIG. 3 is a perspective view of the SMT screen printer in direction B of FIG. 1, with the covers and some other parts omitted to show to show an air jet module of the cleaning device mounted to a X-motion guide.

FIGS. 2 and 3 are further perspective views of the screen printer 100 in directions A and B of FIG. 1 respectively and with the pair of pivotable covers 106 and at least some of the protective panels 108 omitted to show internal parts of the screen printer 100. The screen printer 100 includes a stencil 110 having a print pattern 112 defined by a plurality of apertures 114 through which paste material is deposited onto respective solder pads of the PCB. In this embodiment, the paste material is solder paste. The stencil 110 is substantially planar and includes a top side 116 on which the solder paste is dispensed and a bottom side 118 (see FIG. 7) which engages the PCB, and have sides extending generally in the respective X-axis and Y-axis (see FIG. 8).

The screen printer 100 includes a print head 120 and, as shown in FIG. 3, a paste dispenser 122. The paste dispenser 122 is arranged to dispense the solder paste onto the top side 116 of the stencil 110 and the print head 120 includes a set of squeegee blades 124 for spreading the dispensed solder paste across the print pattern 112 of the stencil 110 to deposit the solder paste through the plurality of apertures 114 and onto corresponding solder pads of the PCB.

The screen printer 100 further includes an X-axis motion guide 126 and a Y-axis motion guide 128 arranged orthogonal to the X-axis motion guide 126. The X-axis motion guide 126 includes a support frame 130 and an elongate print head support member 132 attached to one side of the support frame 130. The print head 120 is slidably attached to the print head support member 132 and is movable linearly along the length of the print head support member 132 and this allows the print head 120 to move along the X-axis of the stencil 110.

The Y-axis motion guide 128 includes two parallel elongate support elements 134, 136 (see also FIG. 3) and ends of the support frame 130 are movably attached to the respective elongate support element 134, 136 to enable the support frame 130 to slide linearly along the elongate support element 134, 136 in a direction orthogonal to the direction of movement of the print head 120 along the elongate print head support member 132. In this way, the print head 120 is suspended over the stencil 110 (see FIG. 10) and movement of the print head 120 (i.e. movement of the support frame 130) along the elongate support elements 134, 136 enables the print head 120 to move along the Y-axis of the stencil 110. Thus, the combination of the X and Y-axis movements along the X-axis motion guide 126 and the Y-axis motion guide 128 enables the print head 120 to access all working areas of the stencil 110 (i.e. the apertures 114 of the print pattern 112).

The screen printer 100 includes a stencil cleaning device 138 and in this embodiment, the stencil cleaning device 138 includes an air jet module 140 and a paper cleaning module 142 (see FIG. 2) for cleaning the bottom side 118 of the stencil 110.

Figure 4:
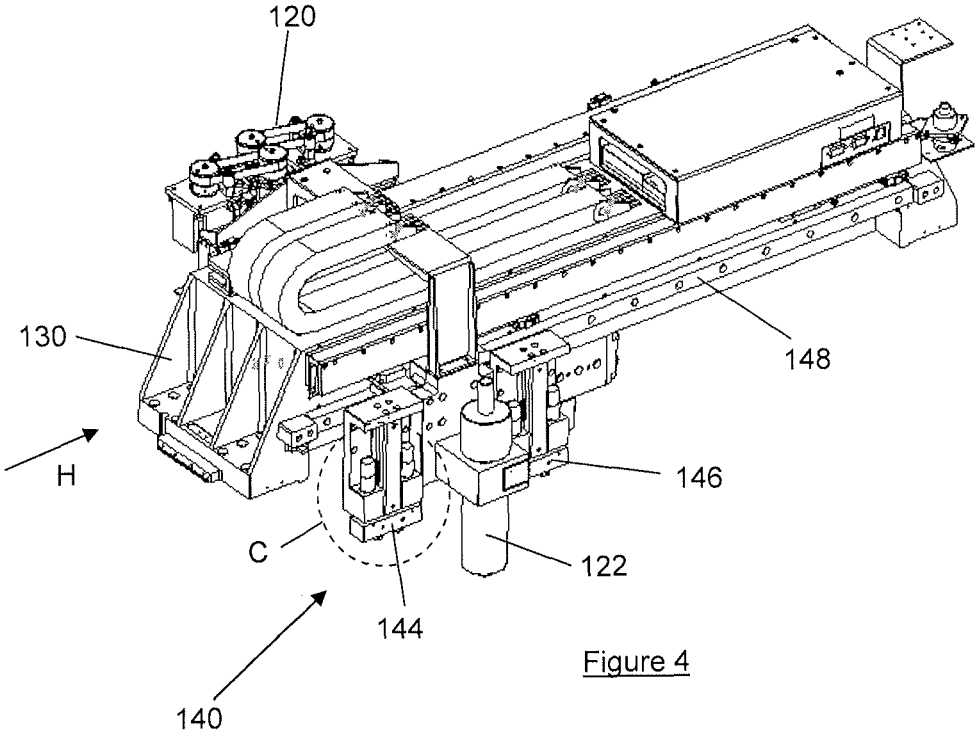
FIG. 4 is an enlarged perspective view of the air jet module and the X-motion guide assembly of FIG. 3 (and also illustrating the print head of FIG. 2)
Figure 5:
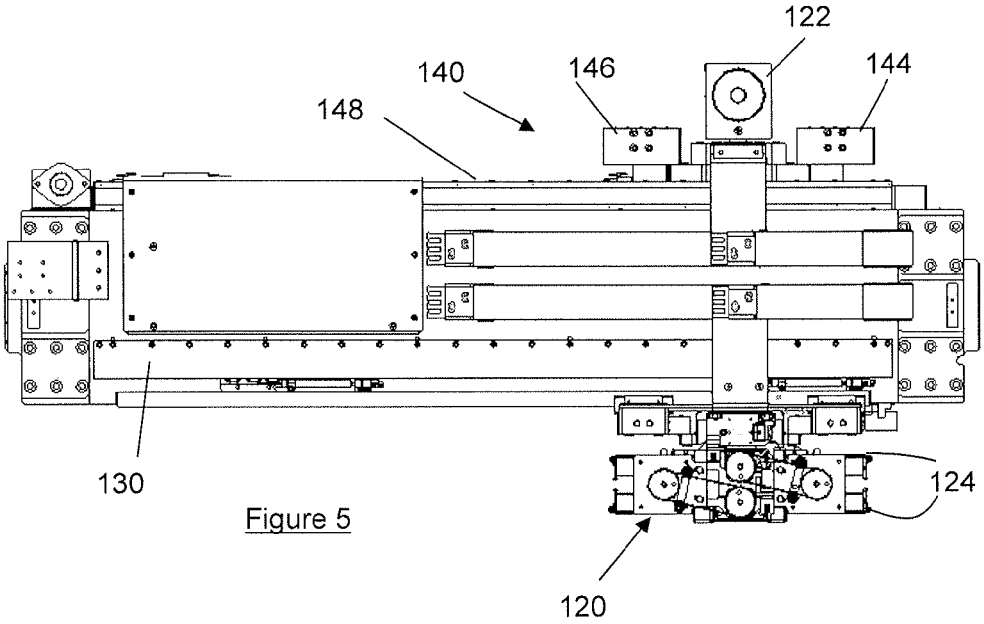
FIG. 5 is a top view of the assembly of FIG. 4.
Figure 6:
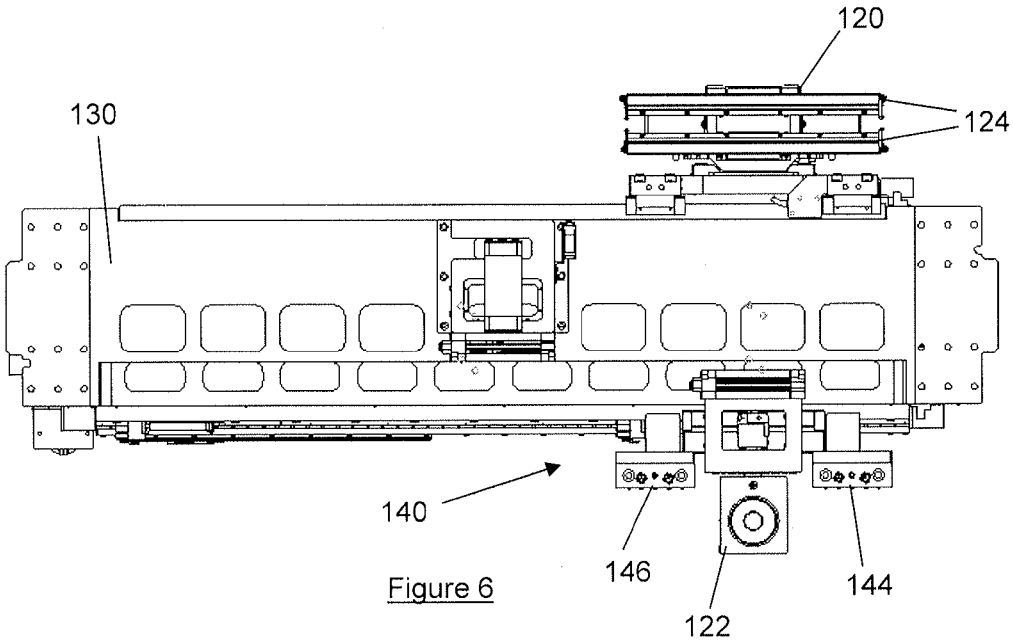
FIG. 6 is a bottom view of the assembly of FIG. 4.

In this embodiment, the air jet module 140 includes two air nozzles 144, 146 for delivering high pressure air jets and the two air nozzles 144, 146 are mounted to an elongate air nozzle support member 148 disposed on another side of the support frame 130 as shown in FIG. 3. FIG. 4 is an enlarged perspective view of the air jet module 140 and the X-axis motion guide 126 (together with the print head 120) to show the two nozzles 144, 146 more clearly, and FIG. 5 is a top plan view of FIG. 4, and FIG. 6 is a bottom plan view of FIG. 4.

It should be appreciated that the two air nozzles 144, 146 are arranged to slide linearly along the air nozzle support member 148 and thus along the X-axis of the stencil 110 i.e. orthogonal to the movement of the support frame 130 which would be along the Y-axis motion guide. It should also be appreciated that the paste dispenser 122 is also mounted to the X-axis motion guide 126 and thus, the X-Y axes movement of the paste dispenser 122 is similar to the air nozzles 144, 146 and the print head 120.

Figure 7:
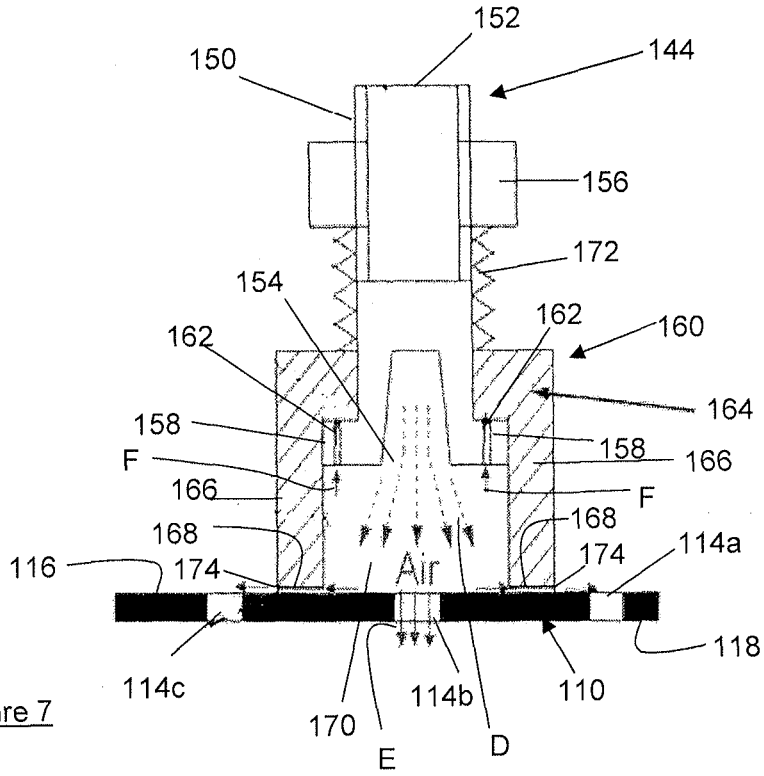
FIG. 7 is an enlarged cross-sectional view of the portion C of FIG. 4 to illustrate internal structure of one of the nozzles of the air jet module.
Figure 8:
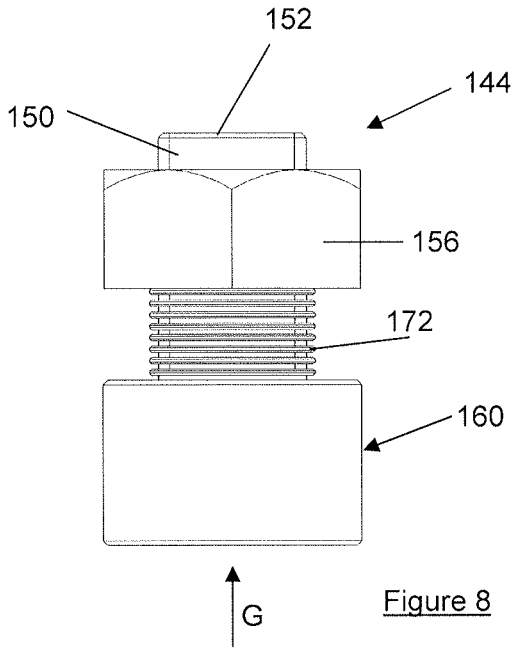
FIG. 8 is a perspective view of only the nozzle of FIG. 7.
Figure 9:
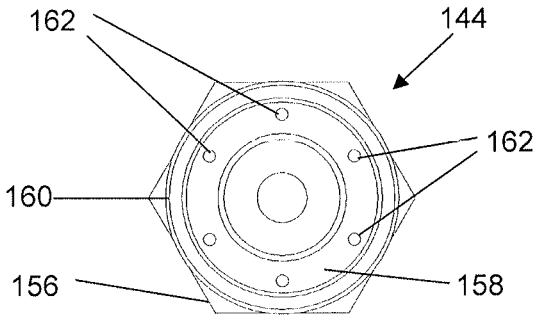
FIG. 9 is an end view of the nozzle of FIG. 8 in the direction G.

FIG. 7 is an enlarged cross-sectional view of portion C of FIG. 4 to show an internal structure of one of the nozzles 144 as well as part of the stencil 110 having the apertures 114. For ease of reference, the apertures will be referred to collectively as 114 and 114*a*, 114*b*, 114*c* when referring to them individually. The nozzle 144 has a generally cylindrical nozzle body 150 having an air inlet 152 connected to an air delivery hose (not shown) and an air discharge outlet 154. Near the air inlet 152, the nozzle 144 includes a nut 156 fixedly coupled to the nozzle body 150 and acting as a stopper. At the air discharge outlet 154, there is a perimeter brim 158 which extends outwards away from the air discharge outlet 154 and which is arranged to support a resiliently biased cap 160, and this is shown more clearly in FIG. 8. The perimeter brim 158 includes a number of air channels 162 which are regularly spaced apart as shown in FIG. 9 and a purpose of these air channels 162 will be apparent later.

The resiliently biased cap 160 has a head portion 164 which rests on the perimeter brim 158 and side sections 166 which extends downwards with end portions 168 for resting on the stencil 110. In this way, the resiliently biased cap 160 forms an air chamber 170 within. As shown in FIG. 7, the nozzle 144 is arranged to clean the aperture 114*b* and thus, the side sections 166 surrounds the aperture 114*b*.

The nozzle 144 includes a spring mechanism 172 with a first end coupled to the nut 156 and a second end coupled to the head portion 164 of the cap 160 to create a biasing force to push the cap 160 towards and against the perimeter brim 158 of the nozzle 144. As continuous jets of air are being discharged through the air discharge outlet 154 into the air chamber 170 in the direction of arrows D, the side sections 166 of the cap 160 directs or concentrates the air flow towards the aperture 114*b* to be cleaned and this results in more effective cleaning. It should be appreciated that part of the air flow exits the air chamber 170 through the aperture 114*b* (arrows E) and in the process, clearing any residual solder paste clogging the aperture 114*b*. Due to the cleaning, the dislodged solder paste may be relocated unpredictably around and the cap 160 helps to trap such dislodged solder paste.

Part of the air flow from the air discharge outlet 154 is also diverted backwards into the air channels 162 (i.e. due to the portions of the stencil 100 where there is no aperture 114), as shown by arrows F. The air "escaping" through the air channels 162 creates a pushing force to lift the cap 160 upwards against the biasing force of the spring mechanism 172 and this creates an air gap 174 (of a few microns) between the end portions 168 and the top side 116 of the stencil 110. In other words, when the nozzle 144 is operating (i.e. cleaning the aperture 114*b*), the cap 160 is not in contact with the top surface 116 of the stencil 110. This non-contact operation is beneficial as it reduces damage to the stencil 110 during the cleaning process.

A size of the air gap 174 may be adjusted by adjusting a preload of the spring mechanism 172 such that with the same airflow and pressure of the air jets being discharged from the air discharge outlet 154, the "lift" of the cap 160 due to the air flowing through the air channels 158 may vary depending on the preload adjustment.

Figure 10:
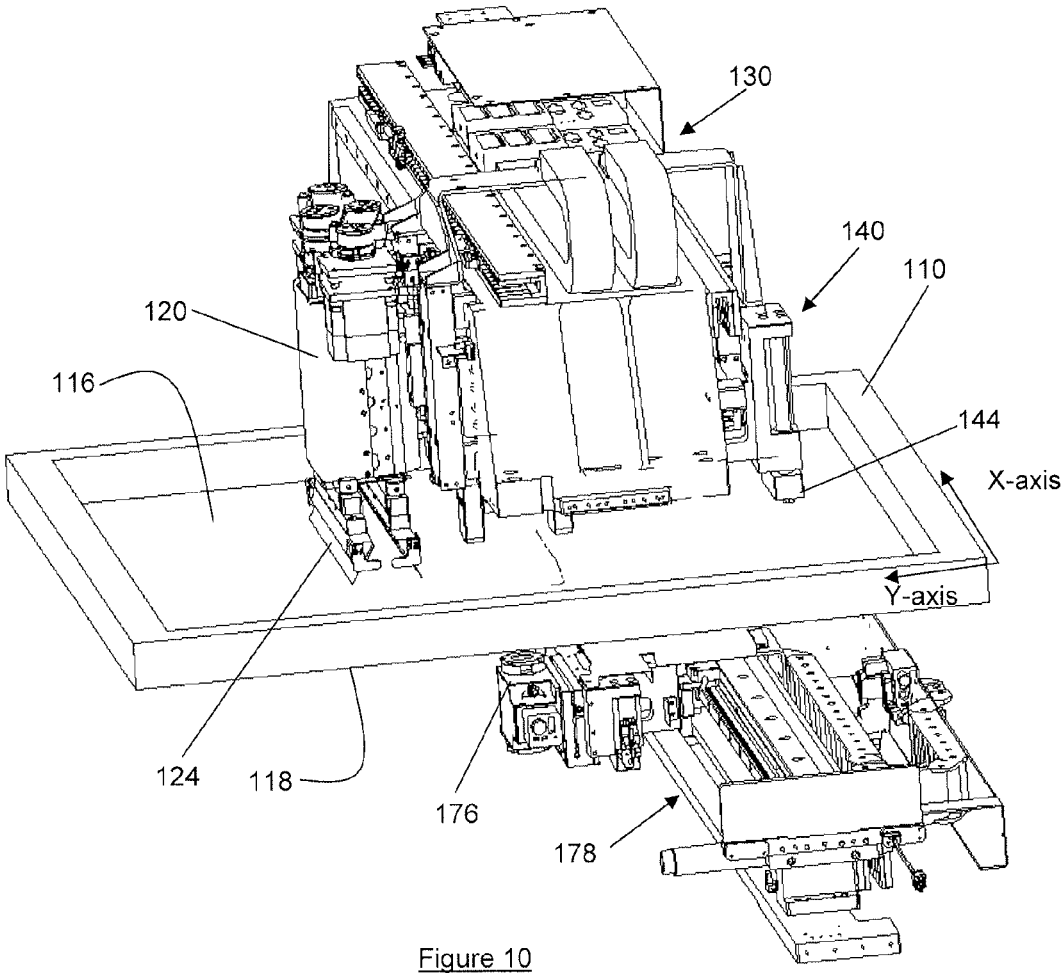
FIG. 10 is a perspective view of the assembly of FIG. 4, in the direction H, of a stencil to be cleaned, and an image capturing device.

FIG. 10 is a perspective view of the air jet module 140 and the X-axis motion guide 126 assembly of FIG. 4, in the direction of arrow H, placed above the stencil 110 and an image capturing device. In this embodiment, the image capturing device includes a fiducial camera 176 configured to capture an image of at least two fiduciary markers on the PCB for alignment with the stencil 110. The fiducial camera 176 is mounted to an X-Y track 178 which enables the fiducial camera 176 to move across the X-axis and Y-axis of the stencil 110.

Further, the fiducial camera 176 is further configured to capture images of the apertures 114 to determine which of the apertures 114 need cleaning. Depending on the size of the stencil 110, the print pattern 112 and size of the apertures 114, the fiducial camera 176 may be configured to take an image of one of the apertures 114 at a time, or take an image of some of the apertures 114, and then take images of the other apertures 114 in sequence to cover the entire print pattern 112. Alternatively, an image of the entire print pattern 112 may be captured. The captured image or images are then processed to determine which of the apertures 114 need cleaning, and the stencil cleaning device 138 is activated to clean those selected apertures 114 which require cleaning. In this embodiment, the fiducial camera 176 is configured to capture a number of images, with each image covering respective sections of the print pattern 112.

Figure 11:
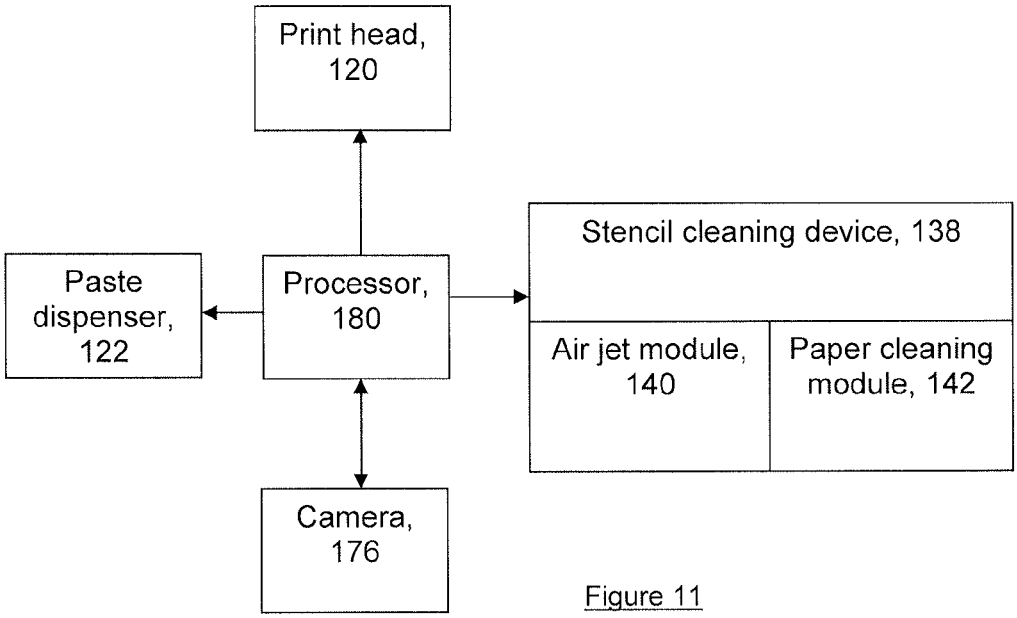
FIG. 11 is a simplified block diagram of the SMT screen printer of FIG. 1 illustrating a processor controlling the other parts of the SMT screen printer.

FIG. 11 is a simplified block diagram of the screen printer 100 which includes a processor 180 (which is part of or analogous to a computing system of the SMT screen printer) for controlling operations of the various parts 120, 122, 138, 176 and an operation of the screen printer 100 will be explained with reference to all the figures.

As would be understood by a skilled person, a PCB having solder pads to be printed with the solder paste is conveyed by the conveyor system 102 into the printing chamber 104 and beneath the stencil 110. At a predetermined location, the processor 180 activates a support platform to raise the PCB to a particular height. The processor 180 next activates the fiducial camera 176 to capture images of the PCB's fiduciary markers and the processor 180 processes these captured images of the fiduciary markers to determine an exact location and alignment of the PCB and based on this information, the processor 180 aligns the stencil 110, if necessary. Once the stencil 110 is aligned with the PCB, the PCB is further lifted so that the PCB engages the bottom side 118 of the stencil 110. Next, the processor 180 activates the paste dispenser 122 to discharge a predetermined amount of paste (depending on the print pattern) on the top side 116 of the stencil 110 and the print head 120 is next activated by the processor 178 to spread the solder paste over the print pattern 112 using the set of squeegee blades 124 by travelling along the X-axis motion guide 126 and the Y-axis motion guide 128 as explained earlier. As it would be apparent, the solder paste flows through the apertures 114 of the stencil 110 to be deposited on corresponding solder pads of the PCB. When the printing is completed, the PCB is lowered and conveyed out of the screen printer 100 for the next process.

The above printing process may be repeated before the processor 180 activates the cleaning process or the cleaning process may be activated after each printing process, and this may depend on the print pattern 112 and/or size of the apertures 114 (or more specifically, the Area-Ratio of the apertures 114).

Figure 12:
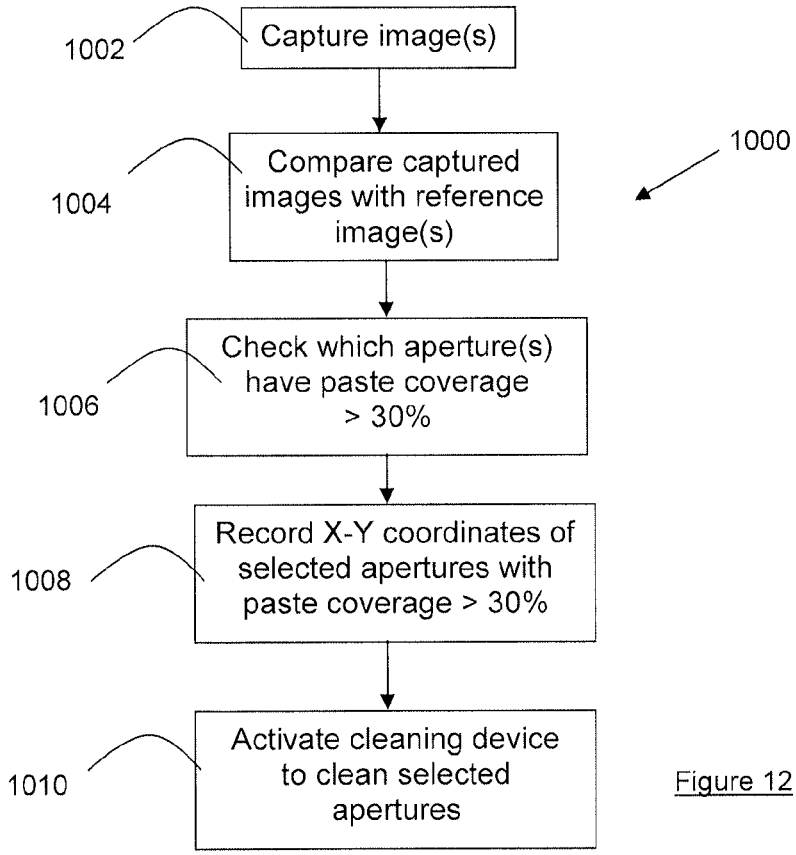
FIG. 12 is a flow chart illustrating steps of a cleaning process for selective cleaning of apertures of the stencil.

FIG. 12 is a flow chart to illustrate the cleaning process 1000. To begin the cleaning process 1000, at step 1002, the processor 180 controls the fiducial camera 176 to capture images of the apertures 114 from the bottom side 118 of the stencil 110 and these captured images are processed by the processor 180 at step 1004 by comparing these captured images with reference images of corresponding apertures of the print pattern 114. The reference images are images of the apertures of the stencil 110 when the apertures are free of any solder paste, and the comparison thus allows the processor 180 to determine the amount of blockage of the apertures 114. The amount of blockage may be set as a threshold in the form of a percentage programmed or selected by a user above which the apertures 114 need to be cleaned (although the screen printer 100 may also be programmed to allow cleaning of all the apertures 100 without checking). For example, if the threshold is 30%, at step 1006, the processor 180 compares the images to determine which of the apertures 114 have residual solder paste blockage of more than 30% and at step 1008 records the X-Y coordinates of those apertures which exceed this threshold as selected apertures 114 which require cleaning.

The processor 180 next activates the cleaning device 138 at step 1010 to clean the selected apertures 114 and in this embodiment, the processor 180 controls the air jet module 140 to move the nozzles 114, 116 along the X-axis motion guide 126 and the Y-axis motion guide 128 to the location of a first one of the selected apertures and lowers the nozzles 114, 116 to a position similar to what is shown in FIG. 7. Almost at the same time, or synchronised with the movement of the air jet module 140, the paper cleaning module 142 of the cleaning device 138 is controlled to move to the first one of the selected apertures but beneath the stencil 110. Next, continuous air jets are released from the air discharge outlet 154 to clean the first of the selected apertures and at the same time the paper cleaning module 142 underneath the stencil 110 is also activated to clean the same aperture. When this aperture is cleaned, the air jet module 140 stops the discharge of the air jets and the paper cleaning module 142 moves to the next selected aperture to be cleaned, until all the selected apertures are cleaned, and the stencil is ready for solder paste printing of the next PCB.

Such selective cleaning of the apertures is more efficient and productive since it requires shorter cleaning time, than cleaning the entire print pattern without prior inspection or checks. The paper cleaning module further uses less cleaning material. Through such a cleaning process, this results in improvement of print quality and also longer cleaning intervals. Use of the air jet cleaning is particularly useful for ultra small aperture cleanings such as area-ratios of 0.5, 0.4, 0.3 or less have been found to be more thoroughly cleaned.

The described embodiments should not be construed as limitative. For example, references to SMT stencil printers and SMT screen printers may be used interchangeably. Also, the printing may be performed on other types of substrates (such as a ceramic substrate) not just PCBs. Likewise, other types of paste material may be used, such as epoxy materials, not just solder paste. Further, instead of using the fiducial camera 176 for inspecting the apertures, a separate camera may be used as part of the image capturing device, although this may not be preferred as it adds to costs. The number of nozzles of the air jet module 140 may be varied depending on the application, and the cleaning device 138 may not have the paper cleaning module 142 or the air jet module 140, since one of these cleaning parts may suffice. Also, other types of cleaning methods may be employed for the selective cleaning, such as chemical or vacuum cleaning etc. It should also be appreciated that any combination of these cleaning methods may be employed as part of the cleaning device 138. The image capturing device may be a digital still camera or may also have video recording functions. Further, the jets of air being discharged from the nozzles 144, 146 may be continuous or pulsating to create different effects.

Having now fully described the invention, it should be apparent to one of ordinary skill in the art that many modifications can be made hereto without departing from the scope as claimed.

The invention claimed is:

1. A screen printer, comprising a stencil having a plurality of apertures;

a paste dispenser arranged to dispense a paste material through the plurality of apertures of the stencil to form a print pattern of the paste material on an electronic device;

an image capturing device arranged to capture at least one image of the plurality of apertures of the stencil;

a processor operative to select which of the apertures of the stencil require cleaning based on the at least one captured image; and a cleaning device arranged to clean the selected apertures, wherein the cleaning device includes an air jet module arranged to discharge jets of air for cleaning the selected apertures, and wherein the air jet module includes at least one air nozzle, and a resiliently biased cap supported by the at least one air nozzle which is movable relative to the air nozzle.

2. A screen printer according to claim 1, wherein the at least one nozzle includes a plurality of air channels for enabling air from the air nozzle to escape to lift the resiliently biased cap away from the air nozzle.

3. The screen printer according to claim 1, wherein the image capturing device is operative to capture multiple images of the plurality of apertures of the stencil with each image showing different selections of the plurality of apertures.

4. The screen printer according to claim 1, wherein the image capturing device includes a fiducial camera for fiducial recognition as well as for capturing the at least one image of the plurality of apertures.

5. The screen printer according to claim 1, wherein the image capturing device includes a camera for capturing the at least one image of the plurality of apertures, and a fiducial camera for fiducial recognition.

6. The screen printer according to claim 1, wherein the processor is operative to compare the at least one captured image with at least one reference image to determine if amount of blockage of the apertures shown in the at least one image exceeds a threshold; wherein apertures having blockages which exceed the threshold are selected for cleaning.

7. The screen printer according to claim 1, wherein the cleaning device includes a paper cleaning module for cleaning the selected apertures.

8. A method of cleaning a stencil of a screen printer, the stencil having a plurality of apertures through which a paste material is dispensed to form a print pattern of the paste material on an electronic device, the method comprising (i) capturing at least one image of the plurality of apertures;

(ii) selecting which of the apertures require cleaning based on the at least one captured image; and (iii) cleaning the selected apertures with a cleaning device;

wherein the cleaning device includes an air jet module arranged to discharge jets of air for cleaning the selected apertures, and the air jet module includes at least one air nozzle, and a resiliently biased cap supported by the at least one air nozzle which is movable relative to the air nozzle.

9. The method according to claim 8, wherein the step of cleaning the selected apertures includes discharging jets of air for cleaning the selected apertures.

10. The method according to claim 9, wherein the jets of air comprise pulsating jets of air.

11. The method according to claim 8, further comprising capturing multiple images with each image showing different selections of the plurality of apertures.

12. The method according to claim 8, wherein the selection includes comparing the at least one captured image with at least one reference image;

from the comparison, determining if an amount of blockage of the apertures shown in the at least one image exceeds a threshold; and selecting the apertures having blockages which exceed the threshold for cleaning.

* * * * *